US010364712B2

(12) United States Patent
Lucatello et al.

(10) Patent No.: US 10,364,712 B2
(45) Date of Patent: Jul. 30, 2019

(54) SYSTEM FOR VARIABLE ACTUATION OF A VALVE OF AN INTERNAL-COMBUSTION ENGINE

(71) Applicant: C.R.F. Societa Consortile per Azioni, Orbassano (Turin) (IT)

(72) Inventors: Marco Lucatello, Orbassano (IT); Francesco Vattaneo, Orbassano (IT); Vittorio Doria, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 141 days.

(21) Appl. No.: 15/364,430

(22) Filed: Nov. 30, 2016

(65) Prior Publication Data

US 2017/0183991 A1 Jun. 29, 2017

(30) Foreign Application Priority Data

Dec. 24, 2015 (EP) ..... 15202665

(51) Int. Cl.

| | |
|---|---|
| ***F01L 9/02*** | (2006.01) |
| ***F01L 13/00*** | (2006.01) |
| ***F02B 75/12*** | (2006.01) |
| ***F02D 13/02*** | (2006.01) |
| ***F02B 69/06*** | (2006.01) |
| *F02B 75/02* | (2006.01) |

(52) U.S. Cl.

CPC ..... *F01L 13/0015* (2013.01); *F01L 9/02* (2013.01); *F01L 9/023* (2013.01); *F01L 9/025* (2013.01); *F01L 13/0036* (2013.01); *F02B 69/06* (2013.01); *F02B 75/12* (2013.01); *F02D 13/02* (2013.01); *F02B 2075/025* (2013.01); *F02B 2075/027* (2013.01); *F02D 13/0203* (2013.01); *F02D 13/028* (2013.01); *F02D 13/0253* (2013.01); *F02D 2200/101* (2013.01)

(58) Field of Classification Search

CPC ..... F01L 13/0015; F02B 75/12; F02D 13/02; F02D 2200/101

USPC ..... 123/321

See application file for complete search history.

(56) References Cited

U.S. PATENT DOCUMENTS

| | | | | |
|---|---|---|---|---|
| 5,553,584 A * | 9/1996 | Konno | F01L 1/267 | 123/90.16 |
| 6,257,176 B1 | 7/2001 | Shimasaki et al. | | |
| 6,439,195 B1 * | 8/2002 | Warner | F01L 13/06 | 123/320 |

(Continued)

FOREIGN PATENT DOCUMENTS

| | | |
|---|---|---|
| EP | 1375843 A1 | 1/2004 |
| EP | 1726790 A1 | 11/2006 |

(Continued)

OTHER PUBLICATIONS

European Search Report dated Jun. 10, 2016 for EP 15202665.4, 5 pages.

*Primary Examiner* — Joseph J Dallo
*Assistant Examiner* — Yi-Kai Wang
(74) *Attorney, Agent, or Firm* — RMCK Law Group PLC

(57) ABSTRACT

Described herein is a system for variable actuation of an engine valve of an internal-combustion engine, where the system is able to actuate the engine valves, selectively, in a four-stroke operating mode and in a two-stroke operating mode, on the basis of the operating conditions of the engine.

6 Claims, 7 Drawing Sheets

(56) References Cited

U.S. PATENT DOCUMENTS

| | | | | |
|---|---|---|---|---|
| 2004/0221820 | A1* | 11/2004 | Opris | F02B 1/12 123/21 |
| 2005/0126522 | A1* | 6/2005 | Ruggiero | F01L 9/021 123/90.12 |
| 2006/0021599 | A1* | 2/2006 | Ciampolini | F02M 59/105 123/446 |
| 2006/0102121 | A1 | 5/2006 | Kalish et al. | |
| 2006/0272598 | A1* | 12/2006 | Wakeman | F01L 1/08 123/21 |
| 2010/0296949 | A1* | 11/2010 | Corley | F01B 17/02 417/279 |
| 2014/0069372 | A1* | 3/2014 | Tietze | F02D 41/0002 123/345 |

FOREIGN PATENT DOCUMENTS

| | | | |
|---|---|---|---|
| JP | S58152139 | A | 9/1983 |
| WO | 2015167412 | A1 | 11/2015 |

* cited by examiner

SYSTEM FOR VARIABLE ACTUATION OF A VALVE OF AN INTERNAL-COMBUSTION ENGINE

CROSS REFERENCE TO RELATED APPLICATIONS

This application claims priority to European Patent Application No. 15202665.4 filed on Dec. 24, 2015, the entire disclosure of which is incorporated herein by reference.

FIELD OF THE INVENTION

The present invention relates to systems for variable actuation of engine valves for internal-combustion engines, of the type comprising:

- a hydraulic apparatus including:
  - a master piston,
  - a slave piston that can be driven by said master piston by means of a volume of fluid set between said master piston and said slave piston, and
  - a solenoid valve configured for assuming a state in which said volume of fluid is set in communication with an outlet so as to render said slave piston independent from the movement of said master piston;
- a camshaft designed to drive said master piston in motion, which has a cam profile for governing, through said master piston, said engine valve in a four-stroke engine operating mode; and
- a control unit configured for controlling said solenoid valve so as to govern said engine valve, in said four-stroke engine operating mode, according to a lift and/or opening and closing times that are variable as a function of one or more parameters indicative of the operating conditions of the engine.

PRIOR ART

The present applicant has for some time been developing internal-combustion engines provided with a system for variable actuation of the engine intake valves, which has the characteristics referred to above and is marketed under the trademark "Multiair". The present applicant is the holder of numerous patents and patent applications regarding engines provided with a system of the type specified above and components of this system.

FIG. 1 of the annexed drawings shows an example of the system in question, which is used for actuation of two intake valves 7 of a cylinder of an internal-combustion engine. In the example illustrated, the system comprises a master piston 2 that is moved by a cam 4 and drives the respective slave pistons 6 of the two intake valves 7, for bringing the latter into the opening condition, by means of the volume of fluid V that sets itself between the slave pistons 6 and the master piston 2.

The solenoid valve 8 controls communication of the chambers of the hydraulic circuit within which the various pistons move with an outlet 12 connected to a fluid accumulator. When the solenoid valve is brought into the closed state B, the master piston 2 and the slave pistons 6 are rigidly connected in the transmission of the motion of opening and closing of the valves 7. When, instead, the solenoid valve is open, the chambers of the various pistons are in communication with the low pressure at the outlet 12, and the slave pistons 6 are hence rendered independent from the movement of the master piston 6. The solenoid valve 8 is normally in the open state, and goes into the closed state following upon electrical actuation of the valve itself.

In the system described, when the solenoid valve 8 is activated, i.e., it is brought into the closed state, the engine valve follows the movement of the cam (full lift). An anticipated closing of the engine valve can be obtained by opening the solenoid valve 8 so as to empty out the volume of pressurized fluid V and obtain closing of the valve 7 under the action of the respective return springs (not shown). Likewise, a delayed opening of the valve 7 can be obtained by delaying closing of the solenoid valve 8, whereas the combination of a delayed opening and an anticipated closing of the valve can be obtained by closing and opening the solenoid valve during thrust of the corresponding cam. According to an alternative strategy, in line with the teachings of the patent application No. EP1726790A1 filed in the name of the present applicant, each intake valve can be controlled in multilift mode, i.e., according to two or more repeated "subcycles" of opening and closing. In each subcycle, the intake valve opens and then closes completely.

In the light of what has been said above, the electronic control unit is consequently able to obtain a variation of the instant of opening and/or of the instant of closing and/or of the lift of the intake valve as a function of one or more operating parameters of the engine, such as the position of the accelerator pedal, the engine r.p.m., or the engine temperature (for example, the temperature of the oil or the temperature of the coolant). This enables an optimal engine efficiency to be obtained in every operating condition.

OBJECT AND SUMMARY OF THE INVENTION

The general object that the present applicant now pursues is to improve further the efficiency of the engine, in particular by providing a system for variable actuation of the valves that will enable one or more of the following advantages to be achieved:

- the possibility of running the engine in a wide range of values of compression ratio, in particular on high values of this ratio;
- an improvement of the consumption levels;
- the possibility of providing engines of small dimensions given the same power delivered;
- the reduction of the work of pumping performed by the pistons; and
- the possibility of providing lower compression ratios within the range of action of the turbosupercharger.

The object indicated above is achieved via a system for variable actuation of an engine valve of an internal-combustion engine, comprising the characteristics of claim 1.

The system described herein is characterized in that it is able to actuate the engine valves, selectively, in a four-stroke operating mode and in a two-stroke operating mode, on the basis of the operating conditions of the engine, in particular on the basis of the conditions of engine load.

The system described herein presents, in general, the following characteristics:

- the camshaft or a further camshaft has a second cam profile for governing the engine valve in a two-stroke operating mode;
- the system further comprises a rocker mechanism having:
  - a first rocker, which is pre-arranged for being actuated by the first cam profile,
  - a second rocker, which is pre-arranged for being actuated by the second cam profile, and
  - a selector device for connecting selectively the master piston with the first rocker and with the second rocker, in such a way that actuation of the first rocker or of the second rocker connected to the master piston determines movement of the master piston under the control of the first cam profile or of the second cam profile; and the control unit is configured for controlling the aforesaid selector device so as to govern the engine valve selectively in one or other of the two operating modes, the two-stroke mode and the four-stroke mode, and, moreover, the control unit is configured for controlling the solenoid valve as a function of the operating mode selected.

In addition to enabling control of the valves in the two two-stroke and four-stroke engine operating modes referred to above, the system described herein is moreover able to provide a variable actuation of the engine valves as a function of the operating conditions of the engine in order to guarantee optimal efficiency whatever the operating condition.

The present invention moreover regards a control method for a system for actuation of the engine valves of the type in question, as defined in claim 6.

BRIEF DESCRIPTION OF THE DRAWINGS AND OF SOME EMBODIMENTS OF THE INVENTION

Further characteristics and advantages of the invention will emerge from the ensuing description with reference to the annexed drawings, which are provided purely by way of non-limiting example and in which.

DETAILED DESCRIPTION OF THE INVENTION

Figure 1:
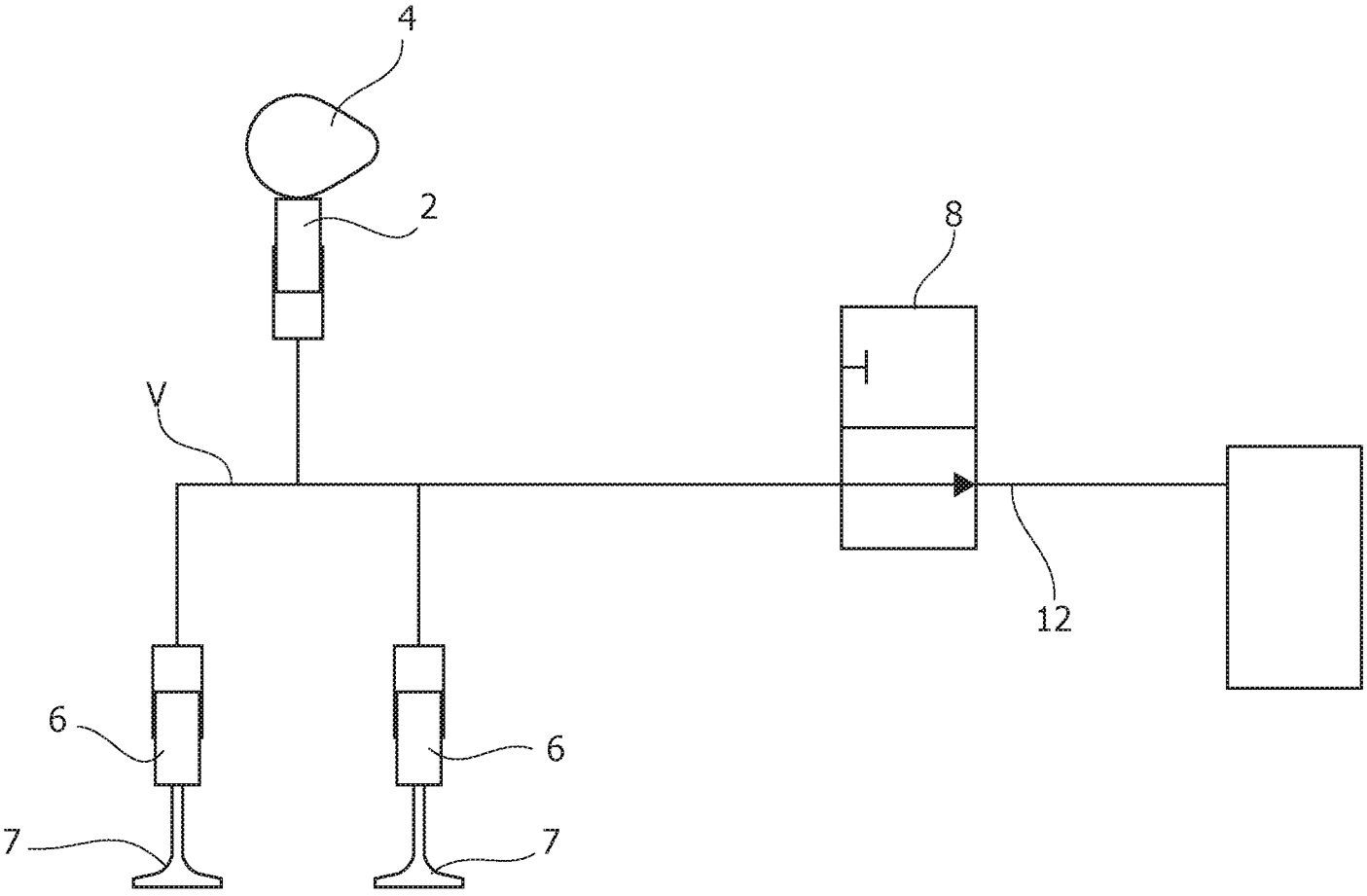
FIG. 1 is a diagram of a system for variable actuation of the valves of an internal-combustion engine, according to the known art.
Figure 2:
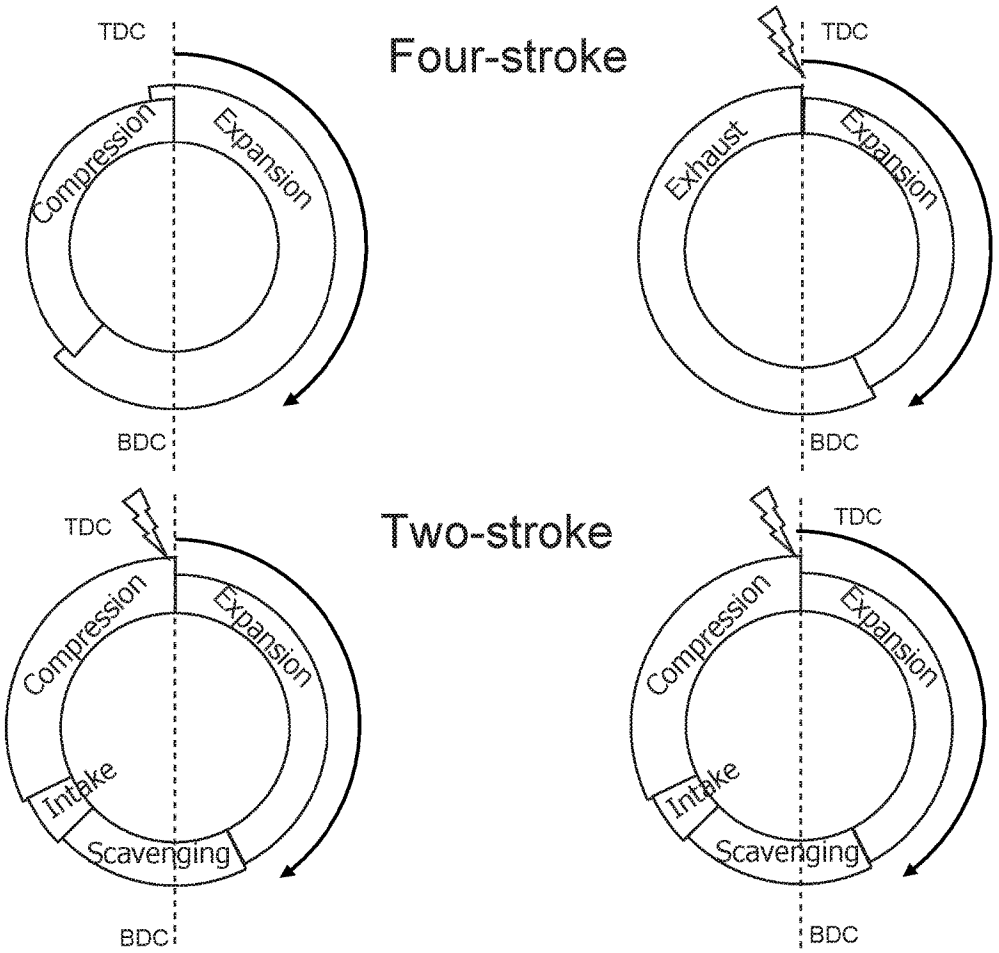
FIG. 2 is a schematic illustration of two examples, one regarding a four-stroke operating cycle and one regarding a two-stroke operating cycle of an internal-combustion engine.

In the ensuing description, various specific details are illustrated aimed at enabling an in-depth understanding of the embodiments. The embodiments may be provided without one or more of the specific details, or with other methods, components, or materials, etc. In other cases, structures, materials, or operations that are known are not shown or described in detail so that various aspects of the embodiment will not be obscured.

The references used herein are only provided for convenience and hence do not define the sphere of protection or the scope of the embodiments.

As is known, a typical four-stroke operating cycle of an internal-combustion engine comprises, in succession, an intake stroke, a compression stroke, an expansion stroke, and an exhaust stroke. The first two strokes, the intake and exhaust strokes, take place in a first crankshaft revolution, whereas the second two strokes, the expansion and exhaust strokes, take place in a subsequent crankshaft revolution. Usually, the intake stroke starts slightly before the end of the exhaust stroke of the previous cycle, when the piston has not yet reached top dead centre (TDC).

Also a two-stroke cycle envisages four strokes—intake, compression, expansion, and scavenging—, which, however, take place during one and the same crankshaft revolution. In this operating mode, exhaust of the burnt gases occurs in the so-called scavenging stroke and mainly occurs as a result of entry of the air-petrol mix into the combustion chamber, which thrusts the burnt gases out of the chamber.

Traditional two-stroke engines do not have the engine valves as a four-stroke engine but ports or slits made directly on the walls of the cylinder, which are opened and closed as a result of the reciprocating motion of the piston.

It should now be noted that in the framework of the technical field in question there have already been proposed four-stroke internal-combustion engines pre-arranged for operating also in the two-stroke mode. This is obtained by providing a set of further cams, specific for the two-stroke mode, and providing appropriate mechanical members designed to set in connection this set of cams with the intake and exhaust valves, and at the same time to disconnect from the latter the cams for the normal four-stroke mode.

In this connection, the document No. JPS58152139 describes a supercharged internal-combustion engine that is pre-arranged precisely with two different sets of cams for actuation of the engine valves, a first set for actuation of the valves in the two-stroke operating mode and a second set for actuation of the valves in the four-stroke operating mode. Selection of one or other of the two sets occurs via a system for positioning of the rockers associated to the valves, which is designed to displace the rockers between their condition of engagement with the cams of one set and their condition of engagement with the cams of the other set.

It should moreover be noted that the cams for a two-stroke cycle are configured in such a way that, in the scavenging stroke, the intake and exhaust valves are kept simultaneously in the open position so that the gases entering from the intake duct can thrust the burnt gases out of the combustion chamber. This action of scavenging of the chamber is on the other hand promoted by the supercharging pressure with which the air-petrol mix is supplied into the combustion chamber.

The advantages for an internal-combustion engine deriving from the possibility of operating also according to a two-stroke cycle principally regard the conditions of high load and lie in the fact that it is possible to exploit a number of combustion events of this cycle that is twice that of a four-stroke cycle in order to reduce the pressures involved that are set up within the combustion chamber. This offers to the designer of the engine the possibility of setting higher compression ratios without any risk of detonation, and, possibly, of reducing the overall dimensions of the engine given the same maximum torque delivered.

The system for variable actuation of the engine valves described herein is pre-arranged for providing the same possibility of passing from a four-stroke operating mode to a two-stroke operating mode, and vice versa, as the one envisaged by the solution of the document No. JPS58152139 discussed above.

However, in the system described herein, this is obtained in combination with a variable actuation of the engine valves of the type described at the start with reference to the system of FIG. 1.

The system described herein hence affords both the advantages deriving from the dual, two-stroke and four-stroke, control mode referred to above and the advantage of being always able to run the engine according to optimal operating parameters whatever the operating conditions.

Figure 3B:
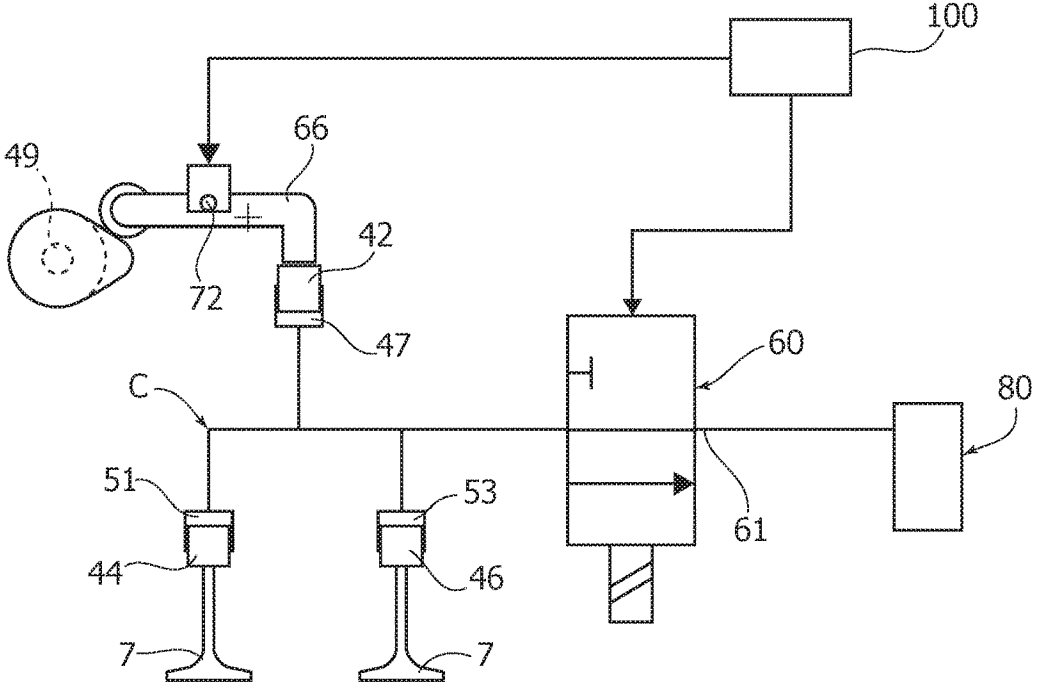
FIGS. 3A and 3B are schematic illustrations of a system for variable actuation of the valves of an internal-combustion engine, according to one embodiment of the invention.
Figure 3A:
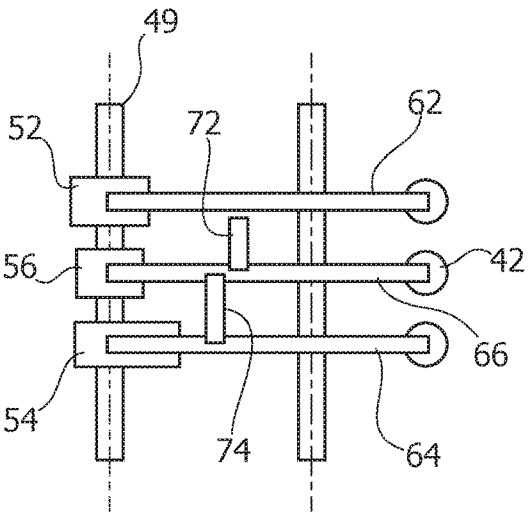

FIGS. 3A and 3B are schematic illustrations of an example of the actuation system described herein; FIG. 3A represents a top plan view of the system, whereas FIG. 3B is a side view. In particular, these figures show application of the system in question for actuation of two intake valves 7 of the cylinder of an internal-combustion engine.

The actuation system described herein comprises, in the first place, a hydraulic valve-actuation apparatus of a type similar to the one described above with reference to FIG. 1. With reference to FIG. 3B, the above apparatus comprises a master piston 42, and two slave pistons 44 and 46, which are designed to drive the two intake valves 7. A hydraulic circuit C defines the respective chambers 47, 51, 53 mobile within which are the pistons 42, 44, 46, and connects hydraulically together the aforesaid chambers in such a way that the movement of the piston 42 induces a corresponding movement of the slave pistons 44 and 46 as a result of the action exerted thereon by the volume of fluid contained in the hydraulic circuit, which is displaced by the piston 42. Moreover, the apparatus in question comprises a solenoid valve 60, which is designed to control hydraulic connection between the chambers 47, 51, 53 and an outlet 61, which is in turn connected to a fluid accumulator 80. When the solenoid valve 60 sets the above chambers in communication with the accumulator 80, the fluid displaced by the piston 42 during its movement induced by the cam is discharged into the accumulator, and consequently the movement of the piston is not transmitted to the two slave pistons 44 and 46. In addition, if in this condition the two intake valves are in the their open position, the corresponding return springs bring them back into the closed position on account of the low pressure that is set up within the circuit, and the volume of fluid that is displaced by the two slave pistons 44 and 46 during this movement of return is also discharged into the fluid accumulator 80.

When, instead, the solenoid valve 60 closes the communication with the above accumulator, the volume of fluid comprised between the chamber 47 and the chambers 51 and 53 is prevented from coming out towards the accumulator 80 and can hence drive the pistons 44 and 46 as a result of the displacement of the piston 42. In this condition, the master piston 42 and the slave pistons 44 and 46 are, as a whole, rigidly connected in both of the movements of opening and closing of the valves. As will be seen in what follows, the movement of opening is governed by the camshaft, and the movement of closing is governed, instead, by the various return springs associated to the two valves and to the aforesaid pistons.

By appropriately controlling the opening and closing times of the solenoid valve 60, it is possible to render in the desired times and ways the engine valves independent from the mechanical profile of the respective cam and hence obtain a variation of the instant of opening and/or of the instant of closing and/or of the lift of the valve. There may hence, for example, be envisaged control strategies characterized by late opening, early closing, a combination of late opening and early closing, or again the so-called multi-lift strategy mentioned above. The various control strategies are saved in the control unit of the system.

For driving the master piston 42, the system comprises two distinct cams, a first one, designated in the figures by the reference 52, for the four-stroke engine operating mode, and a second one, designated in the figures by the reference number 54, for the two-stroke engine operating mode. The two cams in question may be carried by one and the same camshaft—as in the example illustrated where the shaft is designated by the reference 49—or else by two different shafts, according to the specific engine architecture.

It may again be noted that, in the example illustrated, the two valves 7 are controlled via the same hydraulic apparatus as the one described above in detail, and consequently the single cam is designed to actuate both of the valves. However, this constitutes only an example of use of this type of apparatus, and in general the number of valves governed by each cam may vary according to the specific engine architecture.

Figure 4A:
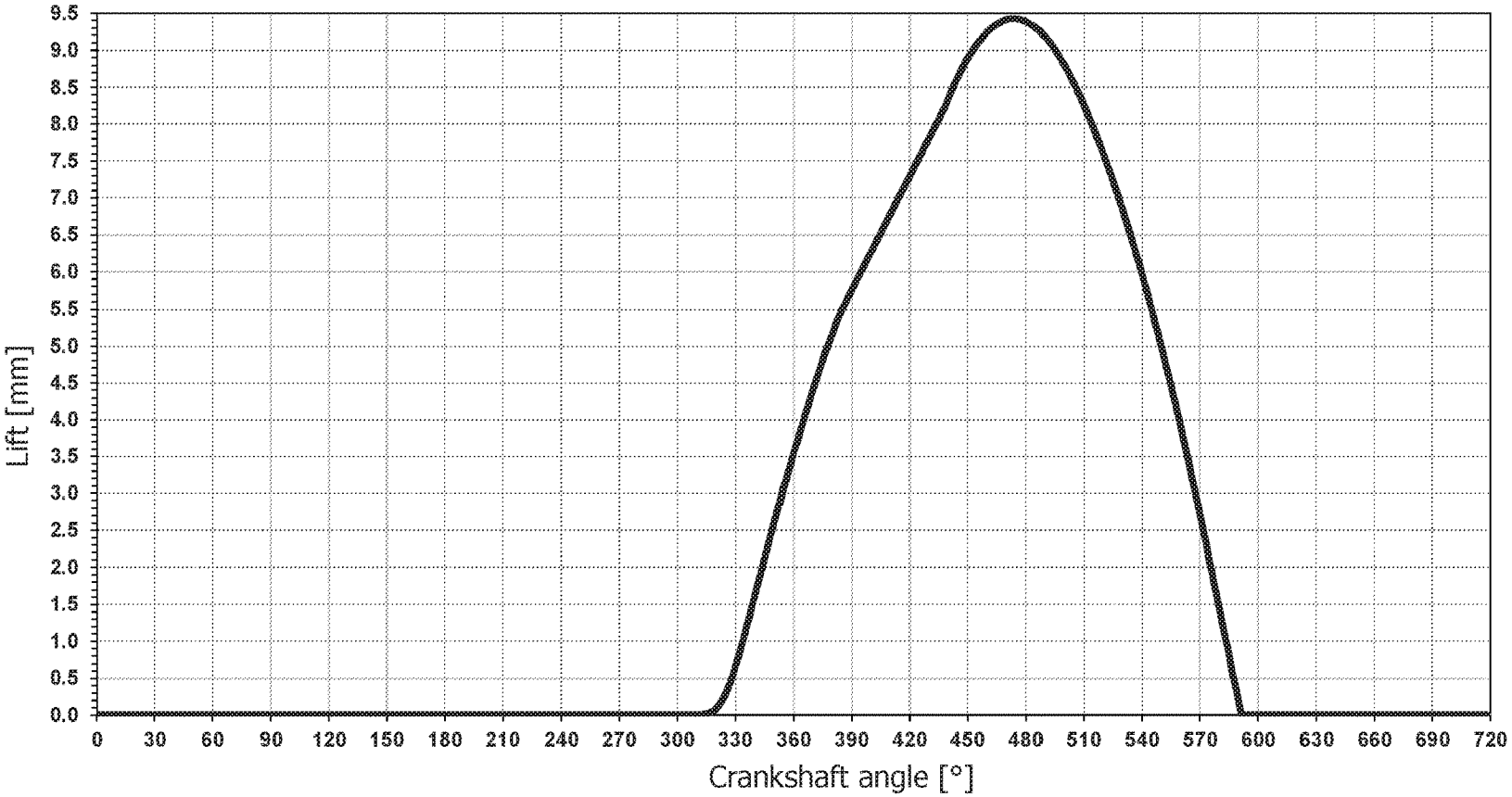
FIGS. 4A and 4B illustrate two different cam profiles for actuation of the intake valves of an engine for a four-stroke engine mode and for a two-stroke engine mode, respectively.
Figure 4B:
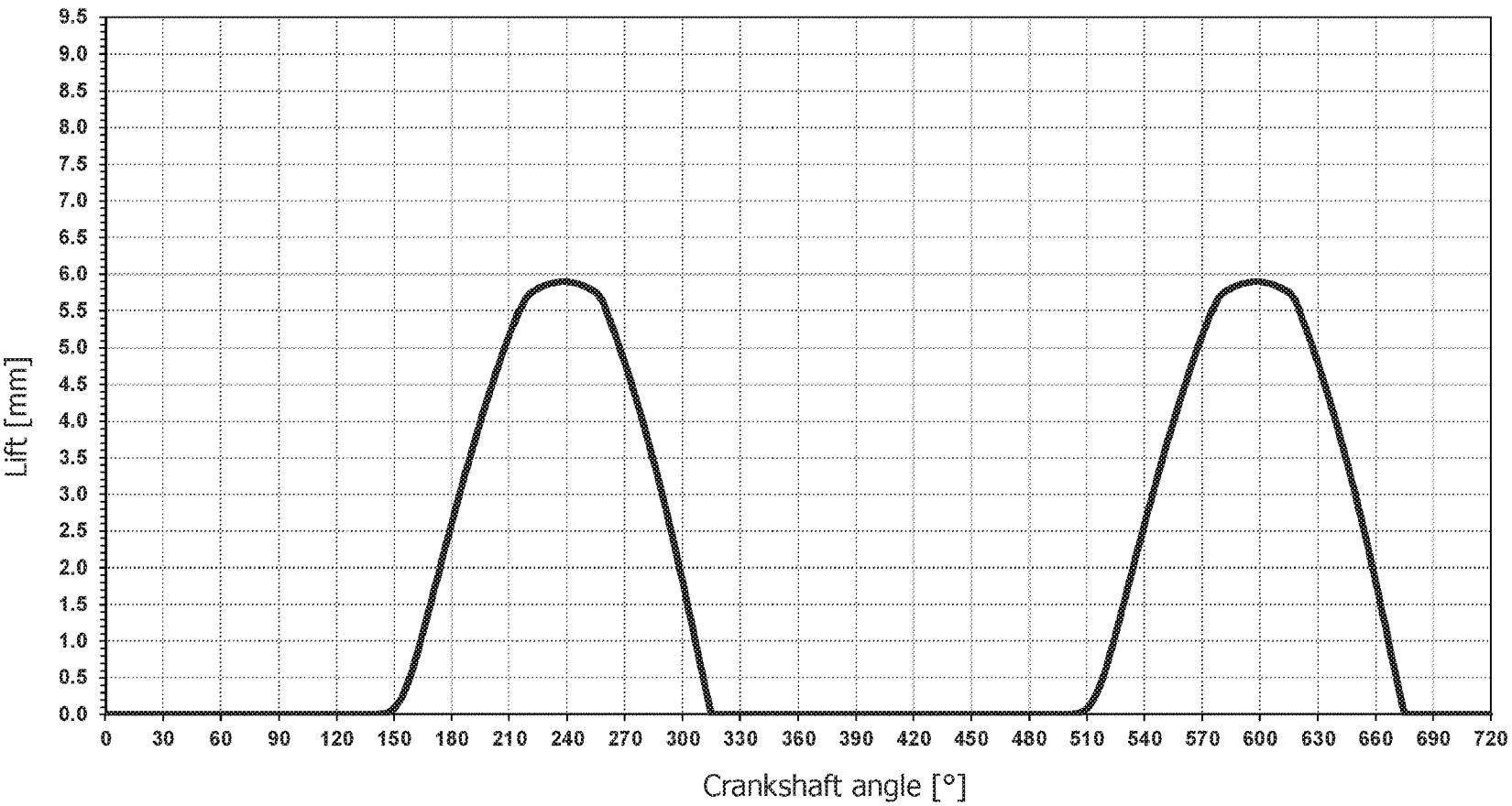

With reference now to FIGS. 4A and 4B, these illustrate, respectively, a cam profile for actuation of the engine valves according to a four-stroke engine operating mode, and a cam profile for actuation of the engine valves according to a two-stroke engine operating mode. The profiles in question are configured each in an appropriate way for governing the valves in the corresponding engine operating mode. From a comparison of these figures, the differences between the two types of profiles are immediately evident. In the first place, the cam profile of the two-stroke mode has two different lift curves, whereas the cam profile of the four-stroke mode just one. Moreover, the two peak values of the first mode are considerably lower than the single peak value of the second mode.

Now, the system described herein further comprises a rocker mechanism for connecting, selectively, the cam 52 and the cam 54 to the master piston 42.

With reference to the FIG. 3A, in various preferred embodiments, as in the one illustrated, the mechanism in question comprises the respective rockers 62, 64 associated to the two cams 52 and 54, and a further rocker 66 connected to the master piston 42 and associated to a further cam 56 having an outer profile corresponding to the basic circle of the cams 54 and 52. The rockers 62 and 64 are both designed to drive, alternatively, the rocker 66 under the control of the respective cams 52 and 54. For this purpose, the mechanism in question comprises a selector device associated to the rocker 66 and designed to connect the rocker selectively to the rocker 62 or to the rocker 64. In various preferred embodiments, as in the one illustrated, the selector device comprises two pins 72 and 74, which are carried by the rocker 66 and which are which can be governed hydraulically for engaging the corresponding rocker, whether the rocker 62 or the rocker 64 (in the example illustrated the pin 72 engages the rocker 62, whereas the pin 74 engages the rocker 64), so as to connect it in rotation to the rocker 66.

Consequently, when the rocker 66 is connected to the rocker 64, the intake valves are governed by the cam 54 in the two-stroke engine operating mode, whereas, when the rocker 66 is connected to the rocker 62, the intake valves are governed by the cam 52 in the four-stroke engine operating mode. The selector device clearly comprises at least one solenoid valve (not illustrated) designed to control the corresponding positions of the pins 72 and 74.

The control unit of the system (designated in FIG. 3B by the reference 100) is configured for selecting the engine operating mode on the basis of the operating conditions of the engine, in particular on the basis of the engine load. In various preferred embodiments, the control unit is configured for selecting the two-stroke engine operating mode for conditions of load higher than a given value, and for selecting instead the four-stroke engine operating mode in the other conditions. The parameters indicated by the system for measuring the engine load may be, for example, the angular position of the accelerator pedal, the pressure inside the intake duct or the exhaust duct, the pressure inside the combustion chamber, etc.

In any case, the control unit has, stored therein, a reference value corresponding to the aforesaid given value of the engine load, and is configured for selecting the operating mode on the basis of the comparison between the measured parameter and the aforesaid reference value.

On the basis of the engine mode thus selected, the control unit is hence configured for controlling the solenoid valve of the selector device so as to connect to the rocker 66 the rocker that is associated to the cam of the selected mode, i.e., either the rocker 64 or the rocker 62.

As mentioned above, the system described herein is in any case also pre-arranged for governing a variable actuation of the engine valves as a function of the operating conditions of the engine, such as speed, load, temperature of the engine, etc., in a way similar to what occurs in the variable-valve-actuation (VVA) systems of the type described at the start with reference to FIG. 1. In particular, by controlling the solenoid valve 60, it is possible to render in the desired times and ways the engine valves independent from the mechanical profile of the respective cam and hence obtain a variation of the instant of opening and/or of the instant of closing and/or of the lift of the valve. There may hence, for example, be envisaged control strategies characterized by late opening, early closing, a combination of late opening and early closing, or again the so-called multi-lift strategy mentioned above.

It should be noted, on the other hand, that, in the system described herein, the aforesaid variable control of the valves is based not only on the operating parameters of the engine referred to above, but also on the operating mode selected.

In the system described herein, it is hence possible to envisage various modes for control of the engine valves—for example, a conventional mode, a late-opening mode, an early-closing mode, a combined late-opening and early-closing mode, and a multi-lift mode—and to differentiate the control modes to be used between one engine operating mode and the other. By so doing, the operating efficiency of the engine is optimal for any condition.

Figure 5A:
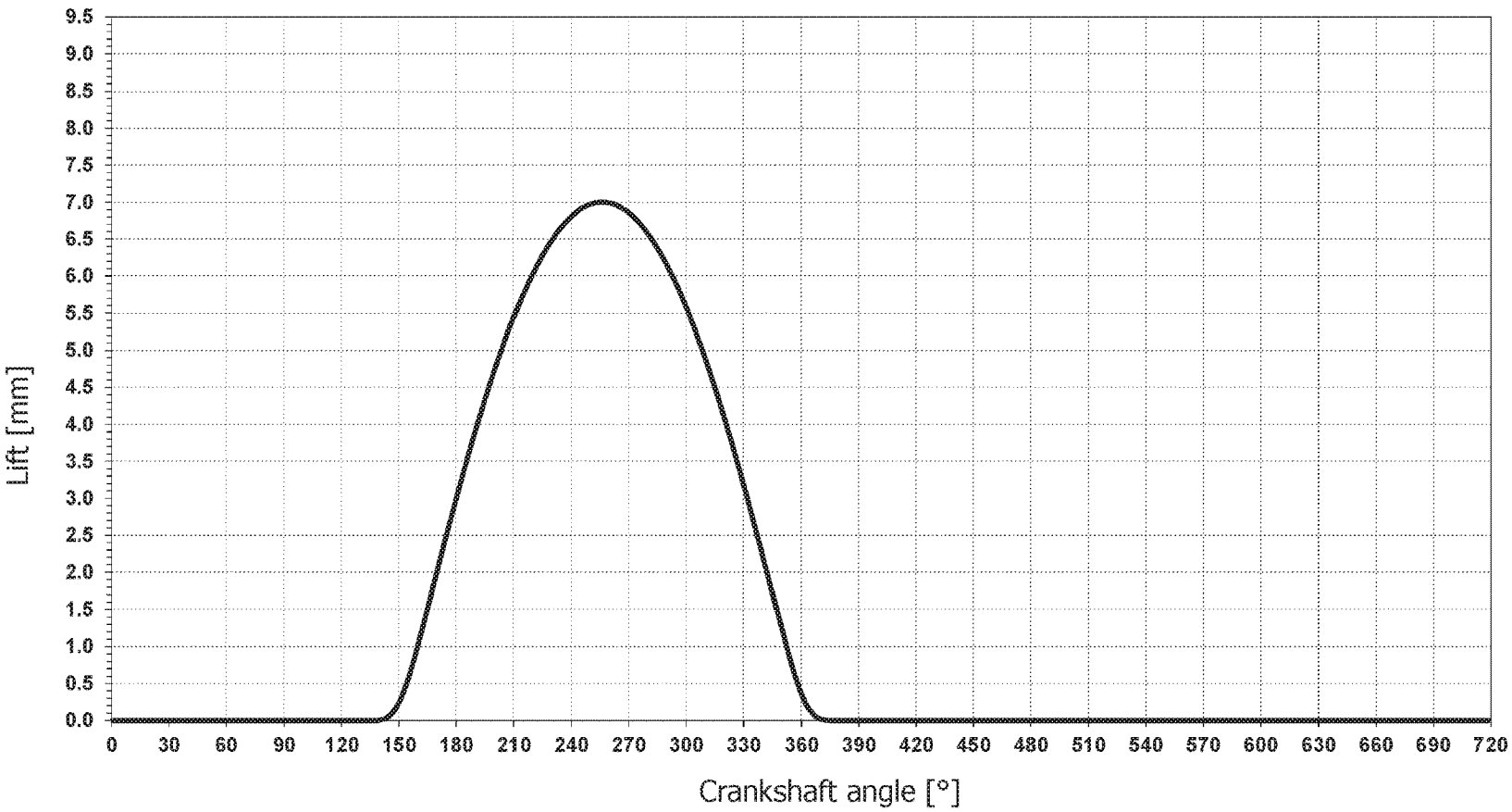
FIGS. 5A and 5B illustrate two different cam profiles for actuation of the exhaust valves of an engine for a four-stroke engine mode and for a two-stroke engine mode, respectively.
Figure 5B:
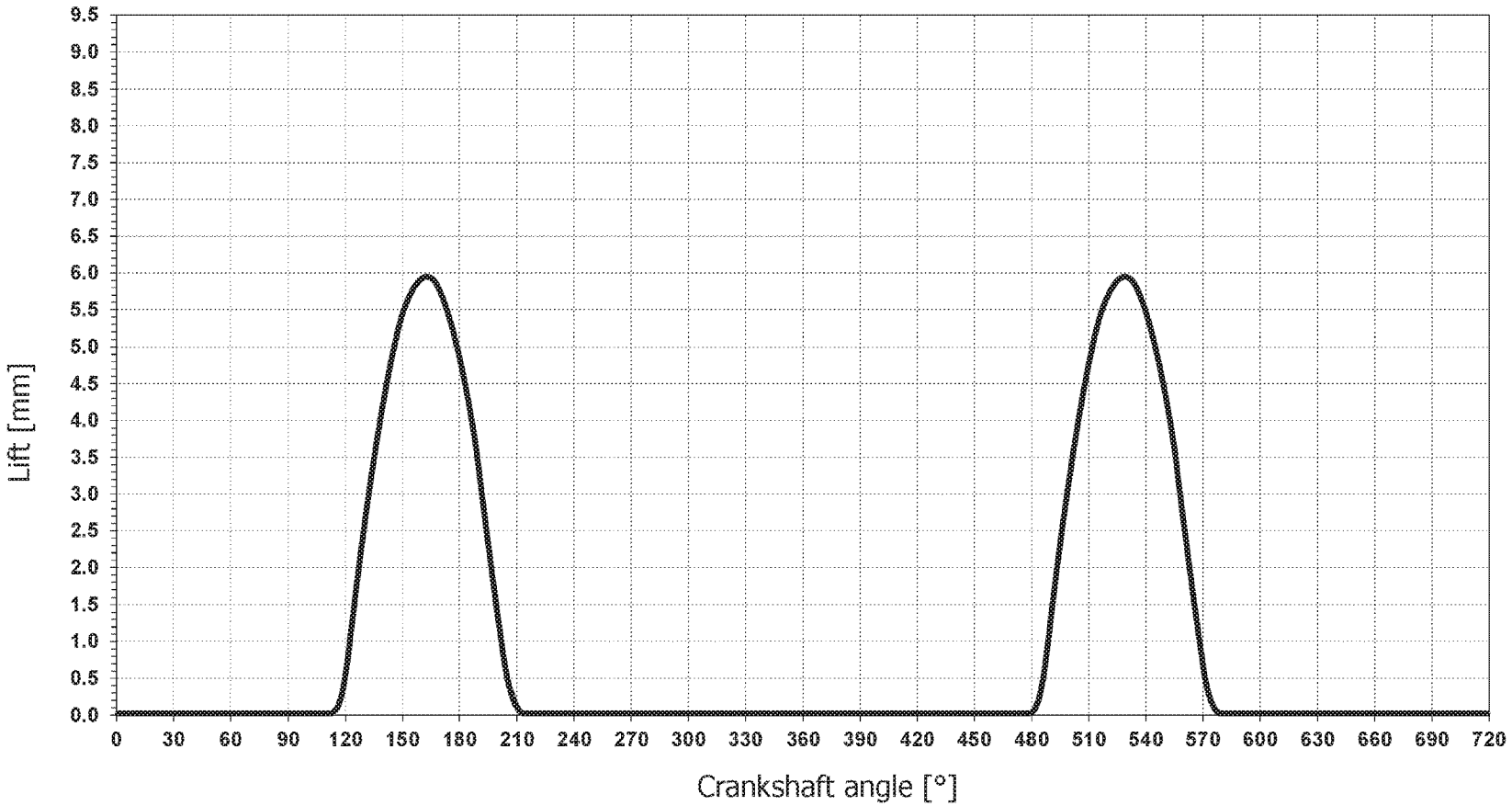

The above description refers to just the intake valves of the cylinder, but it is clear that the same architecture and the same procedure of control described above are applied also for actuation of the exhaust valves precisely in order to be able to control the engine in the two different operating cycles envisaged. In particular, the system will envisage also for the exhaust valves two different types of cam, and, in this connection, FIGS. 5A and 5B illustrate, respectively, a first cam profile for actuation of the exhaust valves according to a four-stroke engine operating mode, and a second cam profile for actuation of the exhaust valves according to a two-stroke engine operating mode.

Of course, without prejudice to the principle of the invention, the embodiments and the details of construction may vary even significantly with respect to what is described and illustrated herein purely by way of example, without thereby departing from the scope of the present invention, as defined by the annexed claims.

Finally, it should noted that the valve 60 indicated above may be a solenoid valve of any known type or else also an electrically actuated valve of a different type, such as a valve with piezoelectric actuator. Also in the case of the solenoid valve, the valve may be of a normally closed type or else of a normally open type. In the latter case, obviously, what is important, for the purposes of the system according to the invention, is the control of the instant when the valve 60 sets up again the communication between the volume of pressurized fluid and the environment communicating with the fluid accumulator 80 irrespective of whether this is obtained by interrupting or activating a current supply.

According to a further characteristic that has already formed the subject of a previous patent application of the present applicant, not yet published at the date of filing of the present application, in the case where the control valve is a normally open solenoid valve, the electronic control unit can be programmed for supplying an electric tail current to the solenoid following upon de-energization thereof in order to brake the movement of the mobile member of the control valve before this reaches its end-of-travel position corresponding to the open condition of the communication between the volume of pressurized fluid and the environment communicating with the fluid accumulator.

What is claimed is:

1. A system for variable actuation of an engine valve of an internal-combustion engine, comprising:

a hydraulic apparatus, including:

a master piston, a slave piston configured to be driven by said master piston by a volume of fluid set between said master piston and said slave piston, and a solenoid valve configured for assuming a state in which said volume of fluid is set in communication with an outlet so as to render said slave piston independent from movement of said master piston;

a camshaft designed to drive said master piston in motion, said camshaft has a first cam profile for governing, through said master piston, said engine valve in a four-stroke engine operating mode;

said camshaft or a further camshaft has a second cam profile for governing said valve in a two-stroke engine operating mode;

a control unit configured for controlling said solenoid valve so as to govern said engine valve, within said four-stroke engine operating mode, according to a lift and/or opening and closing times that are variable as a function of one or more parameters indicative of operating conditions of the engine;

a rocker mechanism having:

a first rocker, which is pre-arranged for being actuated by said first cam profile, a second rocker, which is pre-arranged for being actuated by said second cam profile, a third rocker connected directly to said master piston to drive it in motion, and a selector device for connecting selectively said third rocker and said master piston with said first rocker or said second rocker, in such a way that actuation of the first rocker or the second rocker connected to the master piston via the third rocker determines movement of the master piston under control of the first cam profile or the second cam profile, said control unit is configured for controlling said selector device so as to govern the engine valve selectively in one or the other of the two-stroke and four-stroke engine operating modes, and said control unit is configured for controlling said solenoid valve to open or close hydraulic connection between said volume of fluid, set between said master piston and said slave piston and said outlet, on the basis of the selected two-stroke or four-stroke engine operating mode, and wherein said third rocker is associated to a further cam profile having an outer profile corresponding to a base circle of said first and second cam profiles.

2. The system according to claim 1, wherein said selector device comprises two pins, which are carried by said third rocker and are configured to be hydraulically governed in a condition of selective engagement with said first rocker and with said second rocker, respectively.

3. The system according to claim 1, wherein said control unit is configured for selecting the two-stroke or four-stroke engine operating mode on the basis of the engine load.

4. The system according to claim 3, wherein said control unit is configured for comparing a reference value stored therein with a measured parameter indicative of the engine load.

5. A method for controlling a system for variable actuation of an engine valve of an internal-combustion engine, wherein said system comprises:

a hydraulic apparatus including:

a master piston actuated by a camshaft, a slave piston configured to be driven by said master piston by a volume of fluid set between said master piston and said slave piston, and a solenoid valve configured for assuming a state where said volume of fluid is set in communication with an outlet so as to render said slave piston independent from movement of said master piston;

a camshaft having a first cam profile for governing said engine valve in a four-stroke engine operating mode, and said camshaft or a further camshaft having a second cam profile for governing said engine valve in a two-stroke engine operating mode;

a rocker mechanism having:

a first rocker, which is pre-arranged for being actuated by said first cam profile, a second rocker, which is pre-arranged for being actuated by said second cam profile, a third rocker connected directly to said master piston to drive it in motion and associated to a further cam profile having an outer profile corresponding to a base circle of said first and second cam profiles;

a selector device for connecting selectively said third rocker and said master piston with said first rocker or said second rocker, in such a way that actuation of the first rocker or the second rocker connected to the master piston via the third rocker determines movement of the master piston under control of the first cam profile or the second cam profile; and a control unit configured for controlling said solenoid valve so as to govern said engine valve according to a lift and/or opening and closing times that are variable as a function of one or more parameters indicative of operating conditions of the engine;

said method comprising:

selecting, by the control unit, one between the two-stroke engine operating mode and the four-stroke engine operating mode on the basis of an operating condition of engine load;

controlling, by the control unit, said selector device so as to govern the engine valve selectively in one or the other of the two-stroke and four-stroke engine operating modes;

controlling, by the control unit, said solenoid valve on the basis of the selected two-stroke or four-stroke engine operating mode so as to govern said engine valve in said selected two-stroke or four-stroke engine operating mode including controlling said solenoid valve to open or close hydraulic connection between said volume of fluid, set between said master piston and said slave piston, and said outlet; and for at least one of the two-stroke and four-stroke engine operating modes, controlling, by the control unit, said solenoid valve so as to govern said engine valve according to a lift and/or opening and closing times that are variable as a function of one or more parameters indicative of the operating conditions of the engine.

6. A system for variable actuation of an engine valve of an internal-combustion engine, comprising:

a hydraulic apparatus including:

a master piston, a slave piston configured to be driven by said master piston by a volume of fluid set between said master piston and said slave piston, and a solenoid valve configured for assuming a state in which said volume of fluid is set in communication with an outlet so as to render said slave piston independent from movement of said master piston;

a camshaft designed to drive said master piston in motion, which has a first cam profile for governing, through said master piston, said engine valve in a four-stroke engine operating mode;

said camshaft or a further camshaft has a second cam profile for governing said valve in a two-stroke engine operating mode;

a control unit configured for controlling said solenoid valve so as to govern said engine valve, within said four-stroke engine operating mode, according to a lift and/or opening and closing times that are variable as a function of one or more parameters indicative of operating conditions of the engine;

a rocker mechanism having:

a first rocker, which is pre-arranged for being actuated by said first cam profile, a second rocker, which is pre-arranged for being actuated by said second cam profile, a third rocker connected directly to said master piston to drive it in motion, said third rocker is associated to a further cam profile; and a selector device for connecting selectively said third rocker and said master piston with said first rocker or said second rocker, in such a way that actuation of the first rocker or the second rocker connected to the master piston via the third rocker determines movement of the master piston under control of the first cam profile or the second cam profile, said control unit is configured for controlling said selector device so as to govern the engine valve selectively in one or the other of the two-stroke and four-stroke engine operating modes, and said control unit is configured for controlling said solenoid valve to open or close hydraulic connection between said volume of fluid, set between said master piston and said slave piston and said outlet, on the basis of the selected two-stroke or four-stroke engine operating mode.

* * * * *